US006230635B1

(12) United States Patent
Mukai et al.

(10) Patent No.: US 6,230,635 B1
(45) Date of Patent: May 15, 2001

(54) DEVICE AND METHOD FOR COMBUSTION OF FUEL

(75) Inventors: Katsuji Mukai; Yoshihiko Sumitani; Toshiyuki Ishinohachi, all of Tokyo (JP)

(73) Assignee: Sumitomo Osaka Cement Co. Ltd. (JP)

( * ) Notice: Subject to any disclaimer, the term of this patent is extended or adjusted under 35 U.S.C. 154(b) by 0 days.

(21) Appl. No.: 09/125,767

(22) PCT Filed: Dec. 25, 1997

(86) PCT No.: PCT/JP97/04858

§ 371 Date: Aug. 21, 1998

§ 102(e) Date: Aug. 21, 1998

(87) PCT Pub. No.: WO98/29690

PCT Pub. Date: Jul. 9, 1998

(30) Foreign Application Priority Data

| | | |
|---|---|---|
| Dec. 27, 1996 | (JP) | 8-351055 |
| May 30, 1997 | (JP) | 9-142427 |
| May 30, 1997 | (JP) | 9-142529 |

(51) Int. Cl.[7] ..... F23D 1/00

(52) U.S. Cl. ..... 110/347; 110/262; 431/8; 431/284; 432/219

(58) Field of Search ..... 431/278, 284, 431/8, 10; 110/104 B, 260, 261, 262, 263, 264, 265, 347; 432/105, 106, 219

(56) References Cited

U.S. PATENT DOCUMENTS

| | | | | |
|---|---|---|---|---|
| 1,950,044 | * | 3/1934 | Wilson | 431/8 |
| 3,127,156 | * | 3/1964 | Shepherd | 431/8 X |
| 4,208,180 | * | 6/1980 | Nakayasu et al. | 431/284 |
| 4,342,598 | * | 8/1982 | Kogan | 432/106 X |
| 4,428,727 | | 1/1984 | Deussner et al. | 431/182 |
| 4,679,512 | * | 7/1987 | Skoog | 110/262 X |
| 4,846,666 | * | 7/1989 | Bilawa et al. | 431/284 X |
| 5,203,692 | | 4/1993 | Wexoe | 431/284 |
| 5,299,512 | | 4/1994 | Olsen | 110/261 |

FOREIGN PATENT DOCUMENTS

| | | | |
|---|---|---|---|
| 26 01 591 | | 7/1977 | (DE) . |
| 3027587 | | 4/1989 | (DE) . |
| 0 129 921 | | 11/1903 | (EP) . |
| 0014812 | | 9/1980 | (EP) . |
| 00440281 | | 8/1991 | (EP) . |
| 0619458 | | 10/1994 | (EP) . |
| 57-35367 | * | 7/1982 | (JO) . |
| 51-116066 | | 10/1976 | (JP) . |
| 52-23697 | | 5/1977 | (JP) . |
| 52-75501 | | 6/1977 | (JP) . |
| 54-140230 | * | 10/1979 | (JP) . |
| 57-83592 | | 3/1982 | (JP) . |
| 59-122805 | * | 7/1984 | (JP) . |
| 59-170729 | | 11/1984 | (JP) . |
| 1-74432 | | 5/1989 | (JP) . |
| 5-18010 | | 3/1993 | (JP) . |

OTHER PUBLICATIONS

JPO/JAPIO Abstract for Japanese Examined Patent Publication No. 57–35368, Journal Section M, Section No. 87, vol. 04, No. 3, p. 129, Jan. 1980.*

JPO/JAPIO Abstract for Japanese Examined Patent Publication No. 2–22289, Journal Section M, Section No. 337, vol. 08, No. 244, p. 91, Nov. 1984.*

* cited by examiner

*Primary Examiner*—Ira S. Lazarus
*Assistant Examiner*—Ljiljana V. Ciric
(74) *Attorney, Agent, or Firm*—Paul & Paul

(57) ABSTRACT

A fuel selected from powder fuels and liquid fuel is ejected through a fuel ejection pipe having an annular ejection opening; primary air is ejected through primary air-ejecting openings arranged on outer and inner sides of the fuel ejection, to form outer and inner primary air-ejection straight streams between which the fuel ejection stream is interposed, and to burn the fuel ejection stream. When a powder fuel is used, optionally, a liquid fuel is further ejected and mixed with the above-mentioned primary air streams, and the liquid and powder fuels are burnt together.

5 Claims, 6 Drawing Sheets

DEVICE AND METHOD FOR COMBUSTION OF FUEL

TECHNICAL FIELD

The present invention relates to an apparatus and method of burning at least one fuel selected from powder fuels and liquid fuels.

BACKGROUND ART

When a powder fuel such as a fine coal powder is burnt, a cylindrical burning apparatus for the fine coal powder as disclosed in Japanese Examined Patent Publication No. 57-35368 can be used. In the burning apparatus, a plurality of inner primary air-ejection openings are arranged in the center portion of the apparatus, a plurality (four to eight) of fine coal powder-ejection openings for ejecting a mixture of the fine coal powder and air for conveying the coal powder are arranged around the inner primary air-ejection openings and are separated from each other by partitions, and further an outer circumferential primary air-ejection slit having an annular cross-sectional profile is arranged around the fine coal powder-ejection openings. In this apparatus, the fine coal powder is ejected in the form of four to eight ejection streams through the ejection openings separated from each other, and a plurality of inner primary air-ejection straight streams and an annular primary air ejection straight stream are ejected in such a manner that the fine coal powder ejection streams are interposed between the inner primary air-ejection streams and the annular primary air ejection stream. Since the flow speed of the fine coal powder ejection streams is lower than that of the inner and outer primary air ejection straight streams, the fine coal powder-ejection streams are accelerated by the inner and outer primary air-ejection straight streams and the fine coal powder is blown away far. During the above-mentioned ejection, high temperature secondary air is introduced from a product-cooling apparatus arranged downstream of the burning chamber into the burning chamber, passes through gaps of the outer primary air-ejection straight stream, enters inside of the outer primary air-ejection straight stream, and is sucked and diffused into the fine coal powder-ejection streams, to burn the fine coal powder.

Also, the burner for burning a fine particulate solid fuel as disclosed in Japanese Examined Patent Publication No. 2-22,289 is provided with a plurality of inner primary air ejection openings arranged in an annular form in the center portion of the burner and separated from each other through partitions, a plurality of fine particulate solid fuel/conveying air-ejection openings arranged in an annular form around the inner primary air-ejection openings, and outer primary air-ejection opening formed in an annular form around the above-mentioned fine particulate solid fuel/conveying air-ejection openings. In the burner, the flow resistances of the fine particulate solid fuel at the ejection end surfaces are made different from each other, and the distribution density of the fine particulate solid fuel is made uneven, to thereby increase the combustion speed and form a short flame.

Where a powder fuel and primary air are ejected, and high temperature secondary air is mixed into the ejected powder fuel and primary air streams to burn the powder fuel, generally, the combustion of the powder fuel is effected by the total primary air amount and the secondary air in an amount corresponding to the difference between the theoretical combustion air amount and the total primary air amount. In this case, the temperature of the primary air is 60 to 80° C. and the temperature of the secondary air is 800 to 1,000° C. Therefore, the merits of the combustion depend on the primary air ratio (which refers to a ratio of the total primary air amount to the theoretical combustion air amount), and the lower the primary air ratio, the better the combustion.

However, when the primary air ratio is decreased to promote the combustion, the flow speed of the primary air ejection streams is decreased accordingly, the mixing of the secondary air into the combustion mixture becomes insufficient, and thus the above-mentioned decreases causes a disadvantage in that the burning velocity of the powder fuel decreases, the fire point temperature decreases, and incomplete combustion of the fine particulate coal occurs. For these reasons, in the conventional apparatus and method for burning the powder fuel, the primary air ratio is generally, about 20 to 25% and it is difficult to practically use a primary air ratio lower than the above-mentioned level.

Also, in the conventional apparatus and method of burning the powder fuel, it is possible, to a certain extent to adjust the position of fire point by controlling the ratio in flow speed of the inner primary air-ejection straight streams to the inner primary air-ejection turning streams. However, in practice, the above-mentioned control of one burner is difficult. It is necessary to change the design of the inner primary air straight stream-ejection openings and the inner primary air turning stream-ejection opening, in response to the performance of the rotary kiln. Also, in this case, when the inner primary straight air streams are too strong, the resultant burning flame is in the form of a narrow angle long flame, the fire point temperature is insufficient. Also, when the inner primary air turning streams are too strong, the resultant burning flame is in the form of a wide angle short flame. In this case, while the fire point temperature is high, the angle of the flame is too wide and thus the furnace wall is greatly damaged. In a worst case scenario, the furnace wall is damaged.

Also, when a liquid fuel is used, in an apparatus and method for burning a liquid fuel in which the liquid fuel is sprayed into a combustion furnace, the sprayed liquid fuel is mixed with primary air, and further with high temperature secondary air, and is burnt. In this case, the combustion of a combustible substance in the liquid fuel is effected in response to the total primary air amount mixed with the liquid fuel and to the secondary air amount corresponding to the difference between the theoretical combustion air amount and the total primary air amount. Usually, the temperature of the primary air is 60 to 80° C. and the temperature of the secondary air is 800 to 1,000° C. Therefore, the merits of the combustion vary in response to the primary air ratio (which refers to a ratio of the total primary air amount to the theoretical combustion air amount. The smaller the primary air ratio, the higher the temperature of air used for the combustion, and as a result, the burning temperature increases and the fire point temperature rises, and thus good burning occurs.

However, when the primary air amount is decreased to make the burning conditions better, disadvantages such as the primary air-ejection stream velocity decreases, the mixing of secondary air become insufficient, the fire point temperature decreases and the liquid fuel is incompletely burnt, occur. For these reasons, when C heavy oil is used as a fuel in the conventional apparatus and method of burning the liquid fuel, the primary air ratio is controlled to about 12 to 15%. When the primary air ratio is further decreased below the above-mentioned level, good combustion of the liquid fuel is difficult in practice.

In the conventional apparatus and method of burning the liquid fuel, it is difficult to adjust the position of the fire point by controlling the flow velocity ratio of the liquid fuel streams sprayed into a combustion furnace to the primary air-ejection streams concurrently formed with the liquid fuel streams. Therefore, the combustion flame formed in the combustion furnace is in a narrow angle long flame form wherein the fire point temperature may not be sufficiently high, or in a wide angle short flame form in which the fire point temperature is sufficiently high, while the flame spreads too widely and thus the furnace wall is greatly damaged. In a worst case, the furnace wall is damaged.

Further, where a powder fuel and a liquid fuel are employed together, an apparatus and method for burning the powder fuel and the liquid fuel is known. In the apparatus and method, the powder fuel and the liquid fuel are ejected together with primary air and are further mixed with high temperature secondary air. In this case, generally, the combustion of these fuels is effected in response to the total primary air amount and the secondary air in an amount corresponding to the difference between the theoretical combustion air amount and the total primary air amount. In this combustion, the temperature of the primary air is 60 to 80° C., and the temperature of the secondary air is 800 to 1,000° C., and thus the merits of the combustion vary depending on the primary air ratio (which refers to a ratio of the total primary air amount to the theoretical combustion air amount), the lower the primary air ratio, the higher the temperature of air used for the combustion, and as a result, the burning velocity increases, the fire point temperature becomes high, and good combustion occurs.

However, when the primary air ratio is decreased to make the combustion conditions better, disadvantages such as the ejection stream velocity decreases, and thus the mixing of the secondary air becomes insufficient, the burning velocity of the powder fuel and the liquid fuel becomes low, the fire point temperature decreases and the fuels are incompletely burnt, occur. For these reasons, in the conventional apparatus and method of mix-burning the fuels, the primary air ratio is usually about 20 to 25%, and it is practically difficult to carry out the mix-burning in a reduced primary air ratio at an increased burning velocity and at an increased fire point temperature. Also, in the conventional mix-burning apparatus and method, it is possible, to a certain extent, to adjust the position of the fire point by controlling the flow velocity ratio of the inner primary air straight streams and the inner primary air turning streams formed together with the straight streams. In practice, the above-mentioned control of one burner is difficult, and thus it is necessary to change the design of the inner primary air straight stream-ejection openings and the inner primary air turning stream-ejection opening, in response to the properties of the rotary kiln. In this case, when the inner primary air straight streams become too strong, the resultant combustion flame is in a narrow angle long flame form in which the fire point temperature is insufficiently low. When the inner primary air turning streams become too strong, the resultant combustion flame is a wide angle short flame in which the fire point temperature is sufficiently high and the flame becomes too wide, and thus the furnace wall is greatly damaged. In a worst case, the furnace wall is damaged.

In view of the conventional burning apparatuses and methods as mentioned above, there is a strong demand for an apparatus and method capable of forming a combustion flame in a narrow angle short flame form, of sufficiently raising the fire point temperature by using a powder fuel or a liquid fuel or using a powder fuel together with a liquid fuel, and of obtaining good combustion without damaging a furnace wall.

DISCLOSURE OF THE INVENTION

An object of the present invention is to provide an apparatus and method of burning a fuel which is capable of forming a burning flame in a narrow angle short flame form having a sufficiently high fire point temperature, by using, for example, a powder fuel or a liquid fuel or using a powder fuel together with a liquid fuel, while damage to the combustion furnace wall is prevented or reduced.

Another object of the present invention is to provide an apparatus and method of burning a fuel, which are capable of rapidly burning a fuel, for example a powder fuel or a liquid fuel or a powder fuel and a liquid fuel with a high efficiency and which do not cause the burning furnace wall to be excessively heated.

The fuel-burning apparatus and method of the present invention enable a cheap fuel, for example, a coal powder or coke powder which contains volatile components in a very small content and thus is considered to be unusable, to be used. Also, the fuel-burning apparatus and method of the present invention enables not only a liquid fuel such as heavy oil but also a slurry of cheap fuel such as a coal powder or cake powder to be used and a reduction in fuel cost to be possible.

The fuel-burning apparatus according to the present invention comprises a means for ejecting at least one fuel selected from powder fuels and liquid fuels; an outer primary air-ejection pipe arranged on the outer side of the fuel ejection means and having a plurality of outer primary air-ejection openings through which the primary air is ejected in parallel to the fuel-ejection direction of the fuel-ejection means; and an inner primary air-ejection pipe arranged on the inner side of the fuel-ejection means and having at least one inner primary air ejection opening through which the primary air is ejected in parallel to the fuel-ejection direction of the fuel-ejection means.

The fuel-burning method of the present invention is carried out by using the above-mentioned fuel-burning apparatus of the present invention and comprises ejecting at least one member selected from powder fuels and liquid fuels through the fuel-ejection means; and ejecting primary air through the outer and inner primary air-ejection openings in the same direction as the fuel-ejection direction, to form outer and inner primary air-ejection streams between which the fuel-ejection stream is interposed.

The above-mentioned fuel-ejecting means usable for the apparatus and method of the present invention may consist of a powder fuel-ejection pipe having an annular ejection opening through which a powder fuel is ejected together with a powder fuel-conveying air, may consist of a plurality of liquid fuel-spraying pipes having liquid fuel-ejection openings which are arranged in one and the same circumference and through which a liquid fuel is radially sprayed, or may consist of a powder fuel-ejection pipe having an annular ejection opening through which a powder fuel is ejected together with powder fuel-conveying air and an additional fuel-ejection means consisting of a liquid fuel-spraying pipes located on the inner side of the inner primary air-ejection pipes and having liquid fuel-spraying openings through which the liquid fuel is radially sprayed.

BEST MODE OF CARRYING OUT THE INVENTION

The burning apparatus and the burning method of the present invention are advantageously employed in rotary kilns for producing cement clinker, magnesia clinker or lime. On the present invention the fuel is at least one member selected from powder fuels and liquid fuels.

Figure 1:
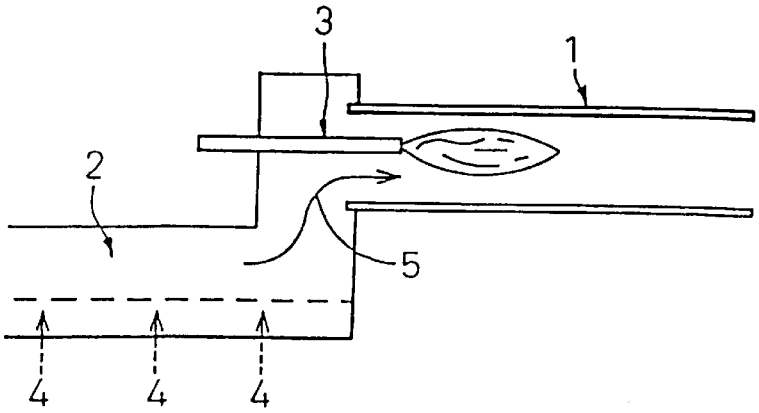
FIG. 1 is an explanatory view showing an arrangement of the burning apparatus of the present invention utilized in a rotary kiln.

As shown in FIG. 1, an outlet portion of a rotary kiln 1 is connected to an inlet portion of a product-cooling apparatus 2, a fuel-burning apparatus 3 is inserted into the outlet portion of the rotary kiln 1 and is directed to the inlet portion of the rotary kiln. A product produced in the rotary kiln 1 is introduced into the product-cooling system 2, cooled by cooling air 4 introduced into the cooling apparatus 2, and high temperature air 5 generated by a heat-exchange in the cooling system 2 is returned, as secondary air, into the rotary kiln 1 through the inlet portion of the cooling apparatus 2 and used for burning a fuel.

Figure 2:
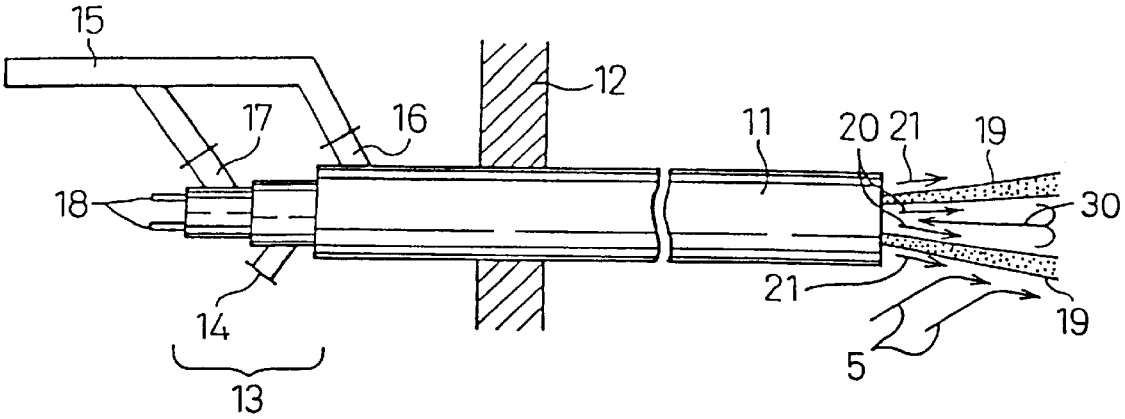
FIG. 2 is an explanatory side view of a heating furnace containing an embodiment of the burning apparatus of the present invention, namely, a powder fuel-burning apparatus, FIG. 3(A) in FIG. 3 is an explanatory cross-sectional side view showing the constitution of an embodiment of the powder fuel-burning apparatus according to the present invention, FIG. 3(B) in FIG. 3 is an explanatory front view of the apparatus shown in FIG. 3(A)

In the present invention, when a powder fuel is used as a fuel, an explanatory side view of an embodiment of a heating furnace including a powder fuel-burning apparatus of the present invention is shown in FIG. 2. In FIG. 2, a cylindrical powder fuel-burning apparatus 11 is inserted into a heating furnace, for example, a rotary kiln, through a furnace wall 12. The burning apparatus 11 comprises a powder fuel-ejection pipe having an annular ejection opening through which a powder fuel is ejected together with air for conveying the powder fuel; an inner primary air-ejection pipe having a plurality of inner primary air-ejection openings and an outer primary air-ejection pipe having a plurality of outer primary air-ejection openings, the inner and outer ejection pipes being respectively arranged along the inner and outer peripheral surface of the powder fuel-ejection pipe.

In FIG. 2, in an end portion 13 of the powder fuel-burning apparatus 11 located outside of the heating furnace, a powder fuel-feeding pipe 14 for feeding a mixed stream of a powder fuel and fuel-conveying air is arranged. The feeding pipe 14 is connected to the above-mentioned powder fuel-ejection pipe. Also, in the end portion 13, a primary air-feeding pipe 15 is arranged. The feeding pipe 5 is branched into an outer primary air-feeding pipe 16 and an inner primary air-feeding pipe 17, the outer primary air-feeding pipe 16 is connected to the outer primary air-ejection pipe and the inner primary air-feeding pipe 17 is connected to the inner primary air-ejection pipe. In the burning apparatus of FIG. 2, two heavy oil or gas burners 18 for ignition are arranged in the center portion of the apparatus.

In the burning apparatus of FIG. 2, a powder fuel stream 19 is ejected through an annular ejection opening, a plurality of inner primary air straight streams 20 are ejected into the inside of the annular powder fuel stream, and a plurality of outer primary air straight streams are ejected to the outside of the annular powder fuel stream, to from a composite stream from the above mentioned streams, and into the composite stream, high temperature secondary air streams 5 are mixed to burn the powder fuel.

The burning apparatus of the present invention for a powder fuel is characterized by having a powder fuel-ejection pipe having an annular ejection opening through which a powder fuel is ejected together with air for conveying the powder fuel, an outer primary air-ejection pipe arranged along the outer peripheral surface of the powder fuel-ejection pipe and having a plurality of ejection openings through which the primary air is ejected in the same direction as the direction of the powder fuel ejection through the annular ejection opening, and an inner primary air-ejection pipe arranged along the inner peripheral surface of the powder fuel-ejection pipe and having a plurality of ejection openings through which the primary air is ejected in the same direction as the direction of the powder fuel ejection through the annular ejection opening.

Also, the burning method of the present invention using the above-mentioned powder fuel-burning apparatus is characterized in that a powder fuel is ejected together with a powder fuel-conveying air through the above-mentioned annular ejection opening, and primary air is ejected through the plurality of outer and inner primary air-ejection openings in the same direction as the powder fuel-ejection stream to form outer and inner primary air straight streams between which the powder fuel-ejection stream is interposed.

Figure 3B:
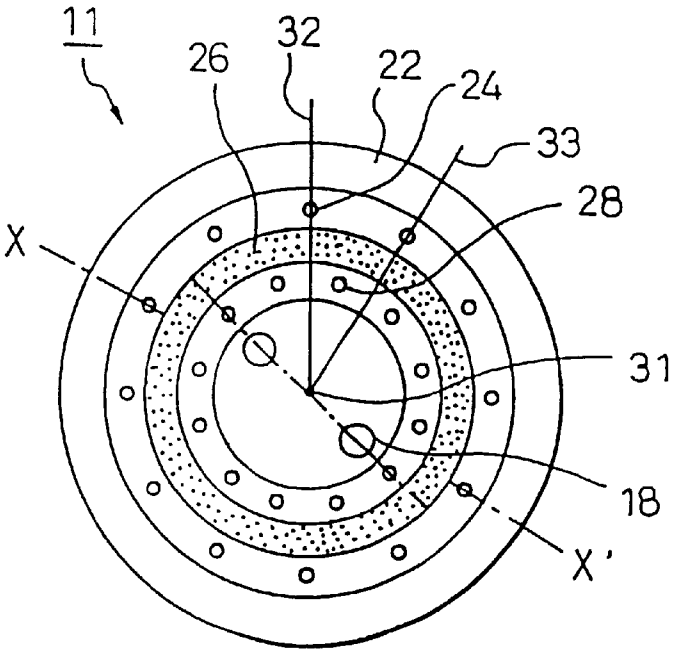
Figure 3A:
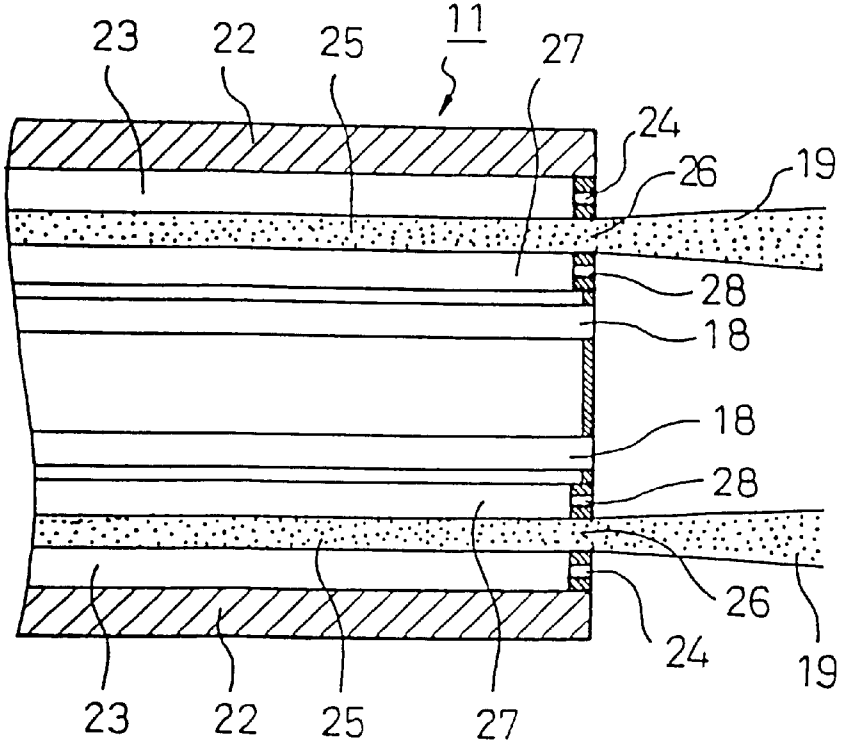

An explanatory cross-sectional side view and an explanatory front view of an embodiment of the powder fuel-burning apparatus of the present invention are shown in FIGS. 3(A) and 3(B). FIG. 3(A) is an explanatory cross-sectional view of the apparatus shown in FIG. 3(B) along a bent line X–X'.

In FIGS. 3(A) and (B), an outer primary air-ejection pipe 23 is arranged inside of an outermost peripheral wall 22 of a cylindrical burning apparatus 11, and in an ejection end of the pipe 23, a plurality, for example, 6 to 16, preferably 8 to 14, of outer primary air-ejection openings 24 are formed. On the inner side of the outer primary air-ejection pipe 23, a powder fuel-ejection pipe 25 for ejecting a mixture of a powder fuel with powder fuel-conveying air is arranged in a concentric circular relationship to the outer primary air-ejection pipe 23, and in the end of the pipe 25, an annular powder fuel-ejection opening 26 is formed. Further, on the inner side of the powder fuel-ejection pipe 25, an inner primary air-ejection pipe 27 is arranged and in an ejection end of the pipe 27, a plurality, for example, 6 to 16, preferably 8 to 14, of inner primary air-ejection openings 28 are formed.

The above-mentioned annular powder fuel-ejection opening 26, outer primary air-ejection openings 24 and inner primary air-ejection openings 28 are formed so that the ejection directions thereof are the same as each other (or are in parallel to each other). Accordingly, the powder fuel is ejected through the annular powder fuel-ejection opening 26 to form a powder fuel stream 19 having an annular cross-sectional profile, the primary air is ejected through a plurality of outer primary air-ejection openings 24 to form a plurality of outer primary air straight streams. These streams advance along the outside periphery of the powder fuel stream 19. Also, the primary air is ejected through a plurality of inner primary air-ejection openings 28 to form a plurality of inner primary air straight streams which advance along the inner periphery of the powder fuel stream having the annular cross-section. Accordingly, the powder fuel stream is interposed between the outer and inner primary air straight streams and thereby is accelerated and diffused. The diffused powder fuel is mixed with high temperature secondary air passed through gaps formed between the outer primary air straight streams, and is burnt. In this procedure, since the outer primary air streams are ejected into a plurality of divided straight streams at a high velocity, the high temperature secondary air can easily pass through the gaps between the plurality of outer primary air straight streams and can be mixed with the powder fuel stream with a high efficiency to form a burning flame in a narrow angle short flame form and to generate a high fire point temperature. Also, in this burning procedure, the plurality of inner primary air straight streams effectively serve to promote the diffusion of the powder fuel and simultaneously to cause an inner circulation flow having a high temperature to be formed in the burning flame to stabilize the flame.

In the burning apparatus of the present invention for the powder fuel, there is no limitation to the form, dimensions and arrangement of the inner primary air-ejection openings 28 and the outer primary air-ejection openings 24. Preferably, the pitch circle diameter (P.C.D.) of the outer and inner primary air-ejection openings 24 and 28 is 300 to 800 mm.

As shown in FIGS. 3(A) and 3(B), preferably, a plurality of the outer primary air-ejection openings 24 of the outer ejection pipe 23 and a plurality of inner primary air-ejection openings 28 of the inner ejection pipe 27 are positioned on two concentric circumferences between which the annular powder fuel-ejection opening 26 of the ejection pipe 25 is interposed, and the inner primary air-ejection openings 28 are located apart from straight lines extending through the centers of the outer primary air-ejection opening 24 and the center of the concentric circles. Also, preferably, each of the inner primary air-ejection openings is positioned between a pair of straight lines 32 and 33 extending through each of the centers a pair of outer primary air-ejection openings adjacent to each other and the concentric circle center 31. The above-mentioned arrangement of the primary air-ejection openings enables air eddies to be positively created on both the inner and outer peripheral surfaces of the annular powder fuel-ejection stream. Also, since the inner and outer primary air streams are constituted from many straight streams, the air eddy surface area is very large and thus such an advantageous effect that the powder fuel can be vigorously burnt with a high efficiency can be obtained. In the above-mentioned burning apparatus of the present invention, a means for forming conventional inner primary air turning streams which has been considered necessary to the conventional burning apparatus is unnecessary. Of course, a means for forming the inner primary air turning stream as mentioned above is optionally added to the burning apparatus of the present invention.

The burning method of the present invention for the powder fuel uses the powder fuel-burning apparatus of the present invention. This method is characterized in that the powder fuel is ejected together with air for conveying the powder fuel through the annular ejection opening, and the primary air is ejected through the outer and inner primary air ejection openings in the same direction as that of the powder fuel-ejection stream to form outer and inner primary air straight streams between which the powder fuel-ejection stream is interposed.

In the method of the present invention, the powder fuel is ejected together with the power fuel-conveying air through the annular ejection opening, and the primary air is ejected through a plurality of outer and inner primary air-ejection openings in the same direction as that of the powder fuel-ejection stream to form the outer and inner primary air straight streams between which the powder fuel ejection stream is interposed.

In the method of the present invention, there is no limitation to the sort of the powder fuel. Generally, solid powder fuels such as coal powder and coke powder are used. Otherwise, various wastes, for example, combustible plastic resin powder, garbage powder, wood waste (wood powder), and chaffs can be utilized.

The method of the present invention is very effectively utilized in the rotary kilns usable for the production of cement clinkers, magnesia clinkers and lime. In this case, high temperature secondary air is fed into the rotary kiln through a product-cooling apparatus arranged downstream from the rotary kiln. The high temperature secondary air is mixed into a composite streams comprising the outer primary air straight streams, the powder fuel stream having an annular cross-section and the inner primary air straight streams, and the powder fuel can be burnt with a high efficiency.

In the method of the present invention using powder fuel, the powder fuel is ejected through the annular ejection opening at an ejection velocity of 30 to 50 m/sec, preferably 35 to 45 m/sec, and simultaneously the outer and inner primary air streams are ejected through the outer and inner ejection openings at an ejection velocity of 200 to 300 m/sec, preferably 250 to 300 m/sec, whereas in the conventional method the primary air-ejection velocity was about 100 m/sec.

When the ejection velocities are adjusted as mentioned above, the primary air ratio which refers to a ratio of the total amount of the air ejected through the annular powder fuel-ejection opening and the outer and inner primary air-ejection openings to the theoretical combustion air amount is reduced from the conventional value of 20 to 25% to 8 to 15%, preferably 8 to 12%. Namely, in the burning method of the present invention using the burning apparatus of the present invention, the ejection stream momentum can be increased by 25 to 35%, and the accompanying momentum and the accompanying time of the secondary air can be maintained at a level similar to those in the conventional method. The ejection stream momentum and the secondary air-accompanying momentum can be calculated in accordance with equations (1) and (2) shown below.

$$G_o = m_o U_o \quad (1)$$

$$G_e = K \cdot (m_o (X/2R)^{0.5} - 1) \cdot V_e \quad (2)$$

In equations (1) and (2), $G_o$: ejection stream momentum $G_e$: secondary air-accompanying momentum $m_o$: ejection stream mass flow rate (kg/sec.)

$U_o$: ejection stream velocity (m/sec)

X: ejection stream axis distance (m)

R: ejection stream diameter (m)

$V_e$: ejection stream suction velocity (m/sec)

K: constant number

In the method of the present invention, when the ejection velocity ($U_o$) of the primary air is increased from about 100 m/sec for the conventional method to 200 to 300 m/sec to increase the ejection stream momentum ($G_o$), this increase in the ejection velocity causes the secondary air-accompanying momentum ($G_e$) to increase in proportion to the ejection stream momentum ($G_o$). However, when the secondary air-accompanying momentum ($G_e$) and the accompanying time are held in the levels similar to those in the conventional method, since the mixing of flame ejection stream with air and the combustion in an initial stage are carried out to the similar extent to the conventional method, the amount of the primary air can be reduced. In this case, the reduction in the amount of the primary air can be compensated for by the high temperature secondary air, and therefore the burning rate can be enhanced and the burning efficiency can be improved.

By utilizing the burning apparatus and method of the present invention for the powder fuel, a combustion flame in a narrow angle short flame form can be formed by using the powder fuel, and thus the swirl number (which is a non-dimensional amount representing turning intensity as defined by equation (3) shown below) can be made zero, and a natural ejection stream can be formed. Also, in the conventional apparatus and method, the content of volatile substance in the coal usable for the conventional apparatus and method must be 18% or more. However, by utilizing the apparatus and method of the present invention, the lower limit of the volatile substance content of the usable coal can be decreased to about 10%.

$$SW=G\phi/G_xR \quad (3)$$

Figure 4:
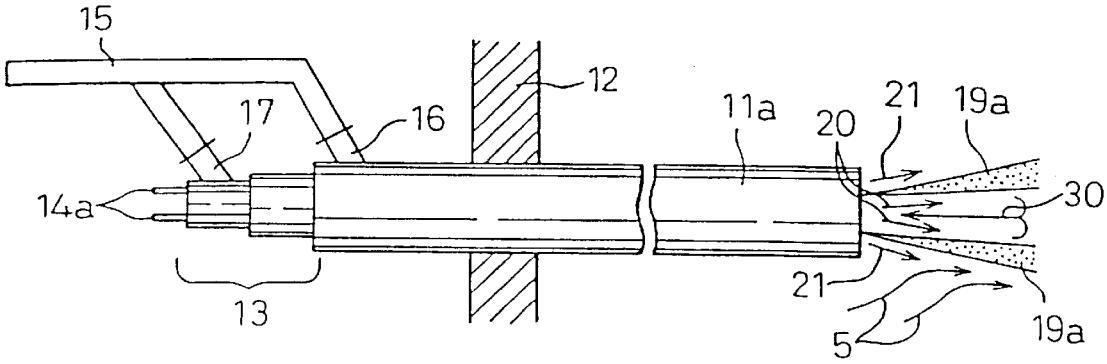
FIG. 4 is an explanatory side view of a heating furnace containing another embodiment of the burning apparatus of the present invention, namely, a liquid fuel-burning apparatus, FIG. 5(A) in FIG. 5 is an explanatory cross-sectional side view showing the constitution of an embodiment of the liquid fuel-burning apparatus according to the present invention, FIG. 5(B) in FIG. 5 is an explanatory front view of the apparatus shown in FIG. 5(A)

In equation (3),

SW: swirl number $G\phi$: angular momentum flux in axial direction $G_x$: thrust in axial direction R: diameter of burner nozzle In the present invention, as a fuel, a liquid fuel can be used. FIG. 4 shows an explanatory side view of an embodiment of the heating furnace containing the liquid fuel-burning apparatus of the present invention.

In FIG. 4, a cylindrical liquid fuel-burning apparatus 11*a* is inserted into a heating furnace, for example, a rotary kiln 1, through a heating furnace wall 12 of the heating furnace. In this burning apparatus 11*a*, a plurality of liquid fuel-spraying pipes 25*a* having liquid fuel-spraying openings 26*a* for radially spraying the liquid fuel are arranged on one and the same circumference, and an inner primary air-ejection pipe 27 having one or more inner primary air-ejection opening 28 for ejecting the primary air and an outer primary air-ejection pipe 23 having a plurality of outer primary air-ejection openings 24 for ejecting the primary air are respectively arranged along the inner and outer sides of the circumference on which the liquid fuel-spraying pipes 25*a* are arranged.

Referring to FIG. 4, a liquid fuel-feeding pipe 14*a* is arranged in an end portion 13 of the liquid fuel-burning apparatus 11*a* located outside of the heating furnace, and connected to the above-mentioned liquid fuel-spraying pipe. Also, a primary air-feeding pipe 15 is arranged in the end portion 13. The primary air-feeding pipe 15 is branched into an outer primary air-feeding pipe 16 and an inner primary air-feeding pipe 17. The outer primary air-feeding pipe 16 is connected to the outer primary air-ejection pipe and the inner primary air-feeding pipe is connected to the inner primary air-ejection pipe. In the burning apparatus 11*a* of FIG. 4, one or more heavy oil burners or gas burners (not shown in FIG. 4) for ignition may be arranged.

In the burning apparatus 11*a* of FIG. 4, liquid fuel streams 19*a* are radially sprayed through spraying openings, inner primary air straight streams 20 are ejected inside of the liquid fuel streams 19*a*, and outer primary air straight streams 21 are ejected outside of the liquid fuel streams 19*a*, to thereby form a composite stream from these streams, and high temperature secondary air 5 is mixed into the composite stream to burn the liquid fuel.

The liquid fuel-burning apparatus of the present invention is characterized by comprising a plurality of liquid fuel-spraying pipes arranged on one and the same circumference and having liquid fuel-spraying openings through which a liquid fuel is radially sprayed; an outer primary air-ejection pipe having a plurality of outer primary air-ejection openings which are arranged on the outer side of the liquid fuel-spraying openings and through which the primary air is ejected in parallel to the center axis direction of the liquid fuel-spraying openings; and an inner primary air-ejection pipe having at least one inner primary air-ejection opening which is arranged on the inner side of the liquid fuel-spraying openings and through which the primary air is ejected in parallel to the center axis direction of the liquid fuel-spraying openings.

Also, the liquid fuel-burning method of the present invention uses the liquid fuel-burning apparatus of the present invention and is characterized in that a liquid fuel is radially sprayed through the liquid fuel-spraying openings, and the primary air is ejected through the outer primary air ejection openings and the inner primary air ejection openings in parallel to the center axis direction of the liquid fuel-spraying openings, thereby to mix the sprayed liquid fuel streams with the outer and inner primary air straight streams and to burn the sprayed liquid fuel.

Figure 5B:
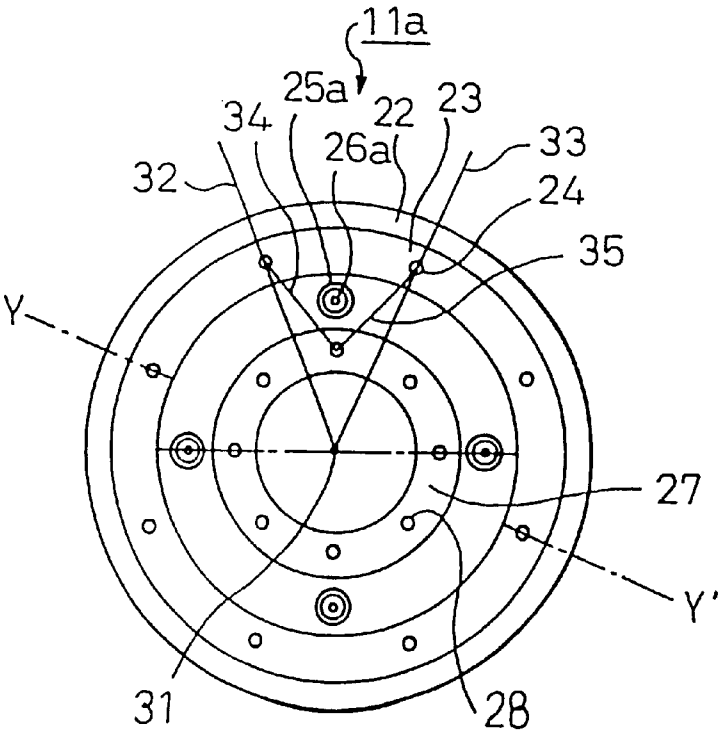
Figure 5A:
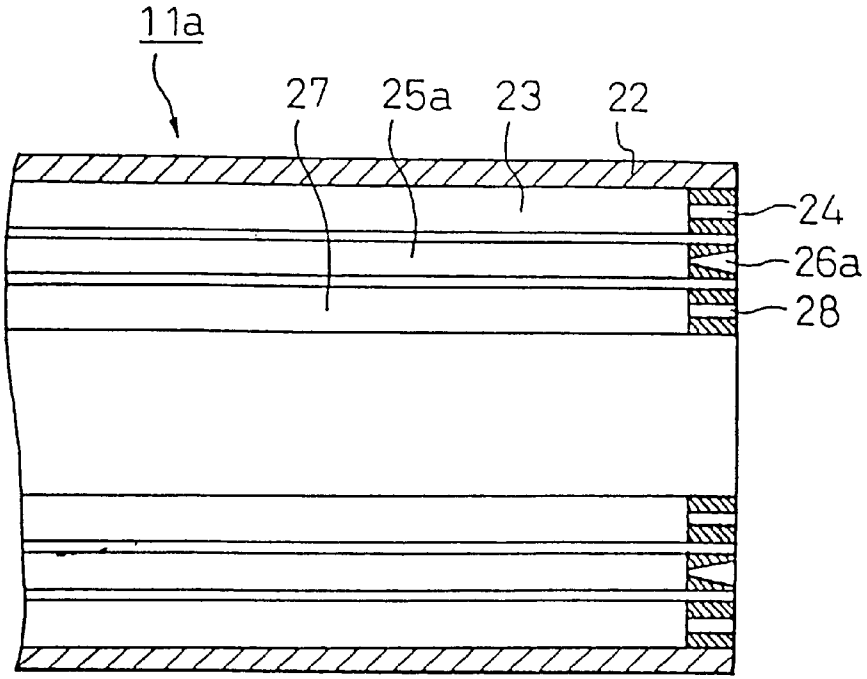

FIGS. 5(A) and 5(B) respectively show an explanatory cross-sectional side view and an explanatory front view of an embodiment of the liquid fuel-burning apparatus. FIG. 5(A) shows an explanatory cross-sectional side view of the apparatus of FIG. 5(B) along a bent line Y–Y'.

In FIGS. 5(A) and 5(B), an outer primary air-ejection pipe 23 is arranged inside of the outermost peripheral wall 22 of a cylindrical liquid fuel-burning apparatus 3, and a plurality, for example 5 to 20, preferably 8 to 18, of outer primary air-ejection opening 24 are formed in the ejection end of the ejection pipe 23. On the inner side of the outer primary air-ejection pipe 23, one or more, for example, 1 to 6, preferably 1 to 4, liquid fuel-spraying pipes 25*a* for spraying a liquid fuel are arranged. In an end of each of the spraying pipes, a liquid fuel-spraying opening 26*a* for radially spraying the liquid fuel is formed. One or more liquid fuel-spraying openings 26*a* are arranged on one and the same circumference around a center 31, and center axes of the liquid fuel spraying openings 26*a* are parallel to each other. Further, an inner primary air-ejection pipe 27 is arranged on the inner side of the liquid fuel-spraying pipe 25*a*, and in an end of the spraying pipe, one or more, for example, 1 to 12, preferably 1 to 8, inner primary air-ejection opening 28 are formed.

The above-mentioned outer primary air-ejection openings 24 and inner primary air-ejection openings 28 are formed in a manner such that the ejection directions of the openings are the same as (parallel to) the center axis directions of the above-mentioned liquid fuel-spraying openings 26*a*. The liquid fuel is sprayed through each of the liquid fuel-spraying openings 26*a* to form a radial stream, and the primary air is ejected through the outer primary air-ejection openings 24 located outside of the spraying openings to form outer primary air straight streams which advance outside of the liquid fuel streams and are mixed with the sprayed liquid fuel. Also, the primary air is ejected through one or more inner primary air-ejection openings 28 to form inner primary air straight streams 20 which advance inside of the liquid fuel streams and are mixed with the sprayed liquid fuel. Accordingly, the liquid fuel streams are mixed with the outer and inner primary air straight streams respectively flowing outside and inside of the liquid fuel streams, and accelerated and diffused by the primary air streams, and are further mixed with the high temperature secondary air passed through the outer primary air straight streams, and are burnt. in this method, the outer primary air stream is ejected at a high velocity to form a straight stream, preferably a plurality of divided straight streams. Therefore, the high temperature secondary air can easily pass between the plurality of outer primary air straight streams and can be mixed with the liquid fuel streams, with high efficiency, to form a combustion flame in the narrow angle short flame form and having a high fire point temperature. Also, when a plurality of inner primary air-ejection openings 24 are formed, the resultant inner primary air straight streams advantageously serve to promote the diffusion of the liquid fuel streams and simultaneously to form high temperature inner circulating streams in the combustion flame so that the flame is stabilized.

In the liquid fuel-burning apparatus of the present invention, there is no limitation on the form and dimensions of the inner primary air-ejection openings 28 and the outer primary air-ejection openings 24. Usually, the pitch circle diameters (P.C.D.) of the outer and inner primary air-ejection openings 24 and 28 are preferably 300 to 800 mm.

Also, each of the liquid fuel-spraying pipes 25*a* having the liquid fuel-spraying openings forms a circular cone-shaped spraying nozzle expanding outward. For example, when C-heavy oil is used as a liquid fuel, preferably the C-heavy oil is heated to a temperature of 85 to 100° C. to reduce the viscosity resistance thereof 20 to 30 cst, and is placed under a pressure of 30 to 40 kg/cm$^2$G.

As shown in FIGS. 5(A) and 5(B), where the inner primary air-ejection pipe 27 has a plurality of inner primary air-ejection openings 28, it is preferable that the plurality of inner primary air-ejection openings and the plurality of outer primary air-ejection openings 24 be located on concentric circumferences around the center point 31 of the circumference on the plurality of liquid fuel-spraying openings 26*a* arranged. Also, where the inner primary air-eject pipe 27 has only one inner primary air-ejection opening 28, it is preferable that the center point of the one inner primary air-ejection opening be identical to the center point 31 of the circumference on which the plurality of liquid fuel-spraying openings 26*a* are arranged, and that the plurality of outer primary air-ejection openings 24 be located on a circumference concentric with the circumference around the center point 31 on which circumference the plurality of liquid fuel-spraying openings 26*a* are arranged. The above-mentioned arrangement of the primary air-ejection openings 24 and 28 allows eddies to be positively created on both the outer and inner sides of the liquid fuel streams, and the primary air to be uniformly mixed with the liquid fuel. Preferably, both the outer and inner primary air streams are respectively formed into numerous straight streams. In this case, it is possible that the eddy surface area becomes large and thus the liquid fuel can be vigorously burnt with a high efficiency. In the liquid fuel-burning apparatus of the present invention, the conventional means for forming inner primary air-turning streams which means is necessary to the conventional apparatus is unnecessary. However, the conventional means for forming the inner primary air-turning stream can be optionally added to the burning apparatus of the present invention.

The liquid fuel-burning method of the present invention uses the above-mentioned liquid fuel-burning apparatus of the present invention. In this method, the liquid fuel is radially sprayed through the liquid fuel-spraying openings, and the primary air is ejected through the outer and inner primary air-ejection openings in parallel to the center axis direction of the liquid fuel-spraying pipes, to thereby mix the sprayed liquid fuel streams with the outer and inner primary air streams and to burn the liquid fuel.

In the method of the present invention, there is no limitation to the sort of the liquid fuel. Usually, the liquid fuel can be selected from liquid state fuels, for example, heavy oils, waste oils and regenerated oils and slurry fuels containing a combustible powder such as coal powder, coke powder and combustible plastic powder, or a waste powder such as garbage, waste wood piece (wood powder), and chaff. The medium for the slurry may be a liquid state fuel (for example, heavy oil, waste oil or regenerated oil) or water.

The method of the present invention can be very advantageously utilized in a rotary kiln usable for the production of cement clinker, magnesia clinker and lime. In this utilization, high temperature secondary air is fed through a product-cooling apparatus arranged downstream to the rotary kiln into the rotary kiln. The high temperature secondary air is mixed into a composite stream formed from the outer primary air straight streams, the liquid fuel-spraying streams and the inner primary air straight streams, to burn the liquid fuel with high efficiency.

In the process of the present invention, the spraying procedure of the liquid fuel through the liquid fuel-spraying openings 26*a* is controlled to such an extent that the sprayed liquid fuel droplets have a size of preferably 10 to 300 $\mu$m, more preferably 10 to 150 $\mu$m. The droplet size is established in response to the sort and viscosity of the liquid fuel and the form and dimensions of the spraying opening. The desired droplet size can be obtained by controlling the pressure applied to the liquid fuel and the form and dimensions of the spraying opening.

The outer and inner primary air is ejected at an ejection velocity of preferably 200 to 300 m/sec, more preferably 250 to 300 m/sec at each ejection opening, whereas the conventional ejection velocity was about 100 m/sec. Under the above-mentioned conditions, the primary air ratio (which refers to a ratio of the total amount of air ejected through the liquid fuel-spraying openings and the outer and inner primary air-ejection openings to the theoretical combustion air amount) can be reduced from the conventional value of 12 to 15% to 5 to 10%, preferably 6 to 9%. Namely, in the burning method using the burning apparatus of the present invention, the spraying stream momentum of the liquid fuel can be enhanced by 25 to 35% based on the conventional momentum, while the secondary air-accompanying momentum and accompanying time are held at levels similar to those of the conventional method.

The spraying stream momentum of the liquid fuel and the accompanying momentum of the secondary air can be calculated in accordance with equations (1) and (2) as mentioned above, in the same manner as for the powder fuel.

In the method of the present invention, when the ejection velocity ($U_o$) of the primary air is increased from the conventional method value of about 100 m/sec to 200 to 300 m/sec, to increase the spraying stream momentum ($G_o$), this increase causes the second air-accompanying momentum ($G_e$) to be increased in proportion to the spraying stream momentum ($G_o$). In this case, when the secondary air-accompanying momentum ($G_e$) and the accompanying time are held at levels similar to those in the conventional method, the mixing of the flame stream with air and the initial stage combustion are carried out to an extent similar to those in the conventional method, and thus the amount of the primary air can be reduced. In this case, since the reduction in the amount of the primary air can be compensated for by the high temperature secondary air, the combustion velocity is enhanced and the combustion efficiency is improved.

By utilizing the liquid fuel-burning apparatus and method of the present invention, the combustion flame in the narrow angle short flame form can be generated in similar manner to that using the powder fuel. Therefore, the swirl number (which is a non-dimensional amount showing a turning intensity defined by equation (3) mentioned above) can be made zero and a natural ejection stream can be formed. Also, in the conventional apparatus and method, there is a limitation on the sort of liquid fuels usable. However, by utilizing the apparatus and method of the present invention, the scope of the usable liquid fuels can be expanded.

Figure 6:
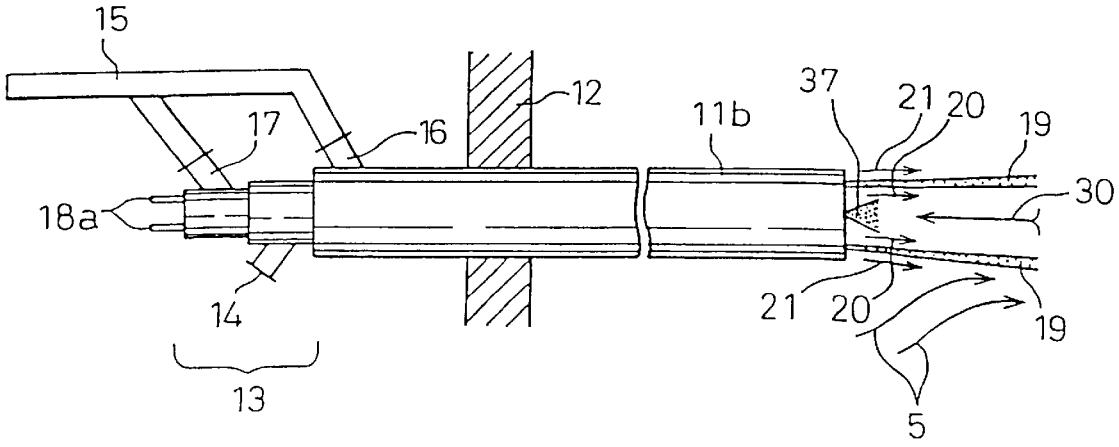
FIG. 6 is an explanatory side view of a heating furnace containing still another embodiment of the apparatus of the present invention, namely a powder fuel and liquid fuel-burning apparatus, FIG. 7(A) in FIG. 7 is an explanatory cross-sectional side view showing the constitution of an embodiment of the apparatus of the present invention for mix-burning a powder fuel and a liquid fuel, FIG. 7(B) in FIG. 7 is an explanatory front view of the apparatus of FIG. 7(A).

In the present invention, a powder fuel can be used together with the liquid fuel. FIG. 6 shows an explanatory side view of an embodiment of the heating furnace containing a mix-burning apparatus of the present invention as mentioned above.

Referring to FIG. 6, a cylindrical mix-burning apparatus 11*b* for a powder fuel and a liquid fuel is inserted into a heating furnace, for example, a rotary kiln, through a wall 12 of the heating furnace. This mix-burning apparatus, which will be explained by referring to FIG. 7 hereinafter, comprises a powder fuel-ejection pipe 25 having an annular ejection opening 26 for ejecting the powder fuel together with air for conveying the powder fuel; an inner primary air-ejection pipe 27 having a plurality of inner primary air-ejection openings 28 for ejecting primary air and arranged along the inner periphery of the powder fuel-ejection pipe 25; an outer primary air-ejection pipe 23 having a plurality of outer primary air-ejection openings 24 for ejecting primary air and arranged along the outer periphery of the powder fuel-ejection pipe 25; and a liquid fuel-spraying pipe 39 having liquid fuel-spraying openings 38 for radially spraying a liquid fuel and arranged in the inside of the inner primary air-ejection pipe 24.

In FIG. 6, in an end portion 13 of the mix-burning apparatus 11*b* located outside of the heating furnace, a powder fuel-feeding pipe 14 for feeding a mixed flow of a powder fuel with powder fuel-conveying air is arranged, and the powder fuel-feeding pipe 14 is connected to the above-mentioned powder fuel-ejection pipe. Also, in the end portion 13, a primary air-feeding pipe 15 is arranged, and this feeding pipe is branched into an outer primary air-feeding pipe 16 and an inner primary air-feeding pipe 17, the outer primary air-feeding pipe 16 is connected to the outer primary air-ejection pipe and the inner primary air-feeding pipe 17 is connected to the inner primary air-ejection pipe.

In the mix-burning apparatus 11*b* of FIG. 6, one or more liquid fuel-feeding pipes 18*a* are located in the central portion of the apparatus. Also, in the central portion, one or more heavy oil burners or gas burners for ignition may be arranged.

In the mix-burning apparatus of FIG. 6, the powder fuel stream 19 is ejected through the annular ejection opening, inner primary air straight streams 20 are ejected into the inside of the annular powder fuel stream, outer primary air straight streams 21 are ejected to the outside of the annular powder fuel stream, and radial liquid fuel spraying streams 37 are sprayed into the inside of the inner primary air straight streams, to thereby form a composite stream from the above-mentioned streams, and high temperature secondary air 5 is mixed into the composite stream to burn the powder fuel and the liquid fuel.

The mix-burning apparatus of the present invention for the powder fuel and the liquid fuel comprises a powder fuel-ejection pipe having an annular ejection opening for ejecting a powder fuel together with powder fuel-conveying air; an outer primary air-ejection pipe having a plurality of outer primary air-ejection openings arranged along the outside periphery of the powder fuel-ejection pipe and capable of ejecting the primary air in the same direction as the direction of the powder fuel-ejection through the annular opening; an inner primary air-ejection pipe having a plurality of inner primary air-ejection openings arranged along the inside periphery of the powder fuel-ejection pipe and capable of ejecting the primary air in the same direction as the direction of the powder fuel-ejection through the annular ejection opening; and a liquid fuel-spraying pipe having liquid fuel-spraying openings arranged inside of the inner primary air-ejection pipe and capable of radially spraying a liquid fuel.

Also, the mix-burning method of the present invention for the powder fuel and the liquid fuel uses the above-mentioned mix-burning apparatus of the present invention for the powder fuel and the liquid fuel and comprises ejecting a powder fuel together with air for conveying the powder fuel through the annular ejection opening; ejecting primary air through the plurality of outer and inner primary air-ejecting openings in the same direction as the direction of the powder fuel ejection stream, to form outer and inner primary air straight streams between which the powder fuel-ejection stream is interposed; and radially spraying a liquid fuel through the liquid fuel-spraying openings, thereby to mix the powder fuel and the liquid fuel with the primary air streams and to burn the powder fuel and the liquid fuel.

Figure 7B:
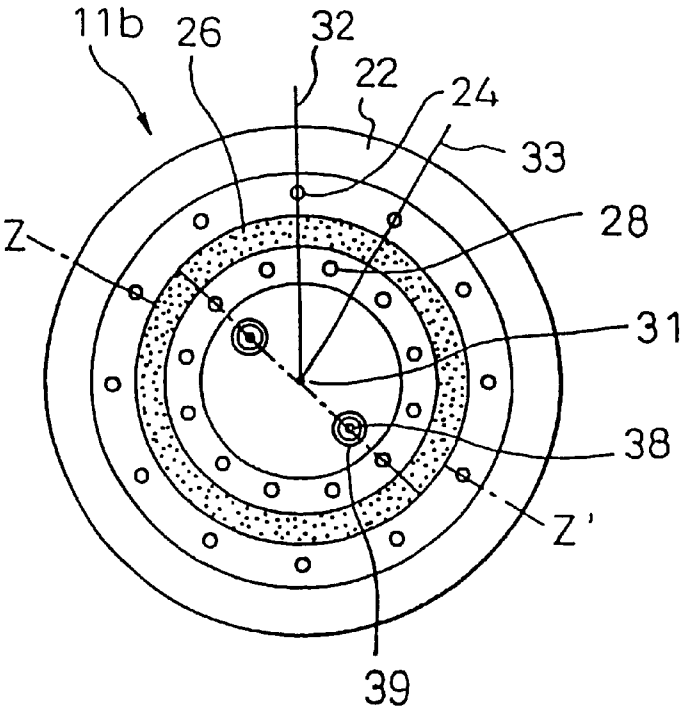
Figure 7A:
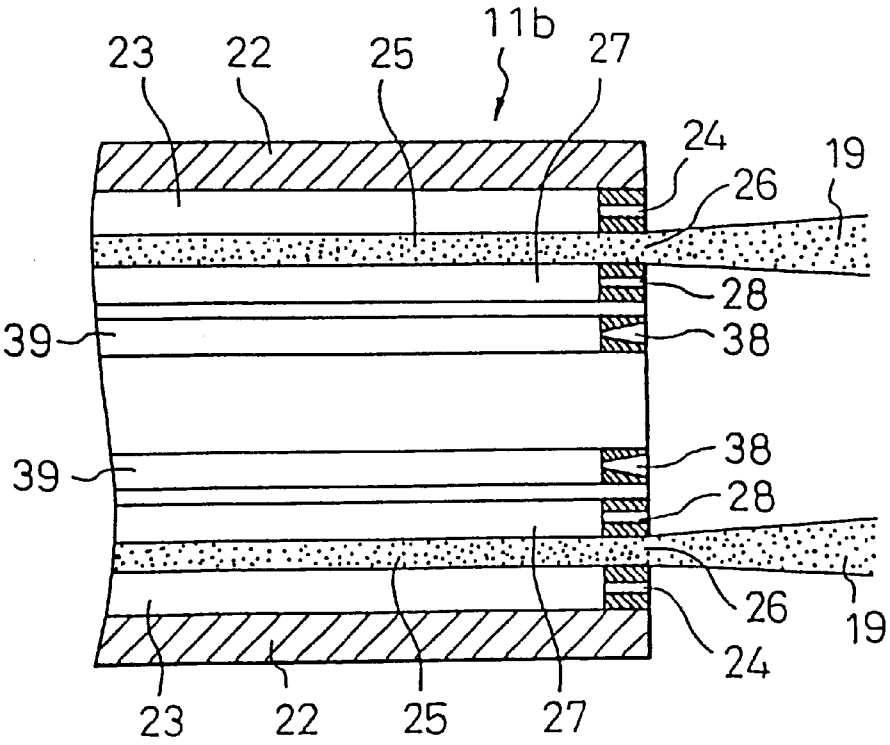

FIGS. 7(A) and 7(B) respectively show an explanatory cross-sectional side view and an explanatory front view of an embodiment of the mix-burning apparatus of the present invention for the powder fuel and the liquid fuel. FIG. 7(A) is an explanatory cross-sectional side view of the apparatus shown in FIG. 7(B) along a bent line Z–Z'.

Referring to FIGS. 7(A) and 7(B), an outer primary air-ejection pipe 23 is located inside an outermost peripheral wall 22 of a cylindrical mix-burning apparatus, and in an ejection end of the ejection pipe 23, a plurality, for example 5 to 20, preferably 8 to 18, of outer primary air-ejection openings 24 are located. Inside the outer primary air-ejection pipe 23, a powder fuel-ejection pipe 25 for ejecting a powder fuel together with air for conveying the powder fuel is arranged in a concentric circular relationship to the outer primary air-ejection pipe 23, and in an end of the powder fuel-ejection pipe, an annular ejection opening is formed. Further, an inner primary air-ejection pipe 27 is arranged on the inner side of the powder fuel-ejection pipe 25, and a plurality, for example, 6 to 16, preferably 8 to 14, of inner primary air-ejection openings 28 are formed in an end of the inner primary air-ejection pipe 27.

Inside the inner primary air-ejection pipe 27, one or more (2 in FIGS. 7(A) and 7(B)) liquid fuel-spraying pipes 39 are arranged, and a liquid fuel-spraying opening 38 for radially spraying a liquid fuel is formed in an end of each of spraying pipe 39. In the liquid fuel spraying opening 38, as shown, for example, in FIG. 7(A), a circular cone-shaped spraying nozzle space expanding outward is formed, and the liquid fuel is sprayed radially through the liquid fuel-spraying opening 38 and mixed with the primary air.

The above-mentioned annular ejection opening 26, the outer primary air-ejection openings 24 and the inner primary air-ejection opening 28 are formed in such a manner that the ejection directions through the openings are the same as (parallel to) each other. Therefore, the powder fuel is ejected through the annular ejection opening 26, to form a powder fuel stream 19 having an annular cross-section and the liquid fuel fed through the liquid fuel-ejection pipes 39 is radially sprayed through the liquid fuel-spraying openings. Further, the primary air is ejected through a plurality of outer primary air-ejection openings 24 to form a plurality of outer primary air straight streams which advance along the outer side of the powder fuel stream 19. Also, the primary air is ejected through a plurality of inner primary air-ejection openings 28 to form a plurality of inner primary air straight streams which advance along the inner side of the powder fuel stream 19 having an annular cross-sectional profile. Accordingly, the powder fuel stream 19 is interposed between the outer and inner primary air straight streams and thereby accelerated and diffused, and mixed with high temperature secondary air passed between the outer primary air straight streams, and burnt. In this case, since the outer primary air streams are ejected at a high velocity in the form of straight streams, preferably a plurality of divided straight streams, the high temperature secondary air can easily pass between the plurality of center primary air straight streams and be mixed with the powder fuel stream 19 and liquid fuel spray streams with a high efficiency, and thus a combustion flame in the narrow angle short flame form can be formed and a high fire point temperature can be generated. Also, in this case, the inner primary air straight streams contribute to promoting the diffusion of the powder fuel stream 19 and the liquid fuel spray streams 37, and to simultaneously forming high temperature inner circulating streams in the combustion flame to stabilize the flame.

In the mix-burning apparatus of the present invention, there is no limitation to the form and dimensions of the inner primary air-ejection openings 28 and the outer primary air-ejection openings 24. Usually, the pitch circle diameters (P.C.D.) of the outer and inner primary air-ejection openings 24 and 28 are preferably 300 to 800 mm. Also, the liquid fuel-spraying openings 38 of the liquid fuel-spraying pipe 39 form a circular cone-shaped spray nozzle expanding outward. For example, if C heavy oil is used as a liquid fuel, preferably the C heavy oil is heated to a temperature of 80 to 100° C. to reduce the viscosity resistance of the fuel to 20 to 30 cst and is put under a pressure of 30 to 40 $kg/cm^2G$.

As shown in FIGS. 7(A) and 7(B), preferably the plurality of outer primary air-ejection openings 24 of the outer primary air-ejection pipe 23, and the plurality of inner primary air-ejection openings 28 of the inner primary air-ejection pipe 27 are respectively arranged on outer and inner concentric circumferences between which the annular opening 26 of the powder fuel-ejection pipe 25 are interposed. Also, preferably, the inner primary air-ejection openings 28 are positioned apart from straight lines extending through the center points of the outer primary air ejection openings 24 and the center point of the above-mentioned concentric circumferences. Further, more preferably, each of the inner primary air-ejection openings 28 is arranged between a pair of straight lines 32 and 33 extending through each of the center points of a pair of outer primary air-ejection openings 24 adjacent to each other and the center point 31 of the above-mentioned concentric circumferences.

The above-mentioned arrangement of the primary air-ejection openings contributes to positively creating eddy streams on both the outer and inner sides of the annular powder fuel stream. Preferably both the inner and outer primary air streams consist of numerous straight streams.

In this case, the surface area of the eddy streams becomes very large and, as an advantageous result, the powder fuel and the liquid fuel can be vigorously burnt with a high efficiency. In the above-mentioned mix-burning apparatus of the present invention, the conventional means for forming inner primary air-turning streams which are necessary to the conventional apparatus, is unnecessary. However, the means for forming the inner primary air-turning streams may be optionally added to the mix-burning apparatus of the present invention. Also, one or more ignition burner (heavy oil burner or gas burner) may be arranged in the center portion of the mix-burning apparatus of the present invention, if necessary.

The mix-burning method of the present invention for the powder fuel and the liquid fuel uses the powder fuel and liquid fuel-mix-burning apparatus of the present invention. In this method, the powder fuel is ejected together with air for conveying the powder fuel through an annular ejection opening, the primary air is ejected through the plurality of outer and inner primary air-ejection openings in the same direction as that of the powder fuel-ejection stream, to form outer and inner primary air straight streams between which the powder fuel-ejection stream is interposed, and further the liquid fuel is radially sprayed through the liquid fuel-spraying openings, and is mixed with the primary air, to thereby mix-burn the powder fuel and the liquid fuel.

In the mix-burning method of the present invention, there is no limitation to the powder fuel. Usually, the powder fuel comprises a solid powder fuel, for example, a coal powder or a coke powder. Otherwise, as a powder fuel, a waste material, for example, combustible plastic powder, waste garbage, waste wood pieces (wood powder) and chaff can be employed.

There is no limitation to the sort of the liquid fuel usable for the mix-burning method of the present invention. Usual liquid state fuels, for example, heavy oils, wasted oils and regenerated oils and combustible powder-containing slurry fuels, for example, slurries containing coal powder, coke powder, combustible plastic powder, and combustible rubber powder, are preferably employed. Also, as a medium for the slurry, water and liquid state fuels (heavy oils, waste oils and regenerated oils may be utilized.

The mix-burning method of the present invention can be very advantageously utilized in the rotary kiln for the production of cement clinker, magnesia clinker and lime. In this case, high temperature secondary air is fed from a product-cooling apparatus arranged downstream from the rotary kiln into the rotary kiln. The high temperature secondary air is introduced into and mixed with a composite stream formed from the outer primary air straight streams, the powder fuel stream having an annular cross-section, the inner primary air straight stream and radially expanding liquid fuel spray streams, and the powder fuel and the liquid fuel can be burnt with a high efficiency.

In the mix-burning method of the present invention, the powder fuel is preferably ejected through the annular ejection opening 26 at an ejection velocity of 30 to 50 m/sec, more preferably 35 to 45 m/sec, and simultaneously the outer primary air and the inner primary air are preferably ejected respectively through the outer and inner ejection openings at an ejection velocity of 200 to 300 m/sec, more preferably 250 to 300 m/sec, whereas the conventional primary air ejection velocity is about 100 m/sec. Also, in the mix-burning method of the present invention, the size of droplets of the liquid fuel sprayed through the spraying openings is preferably controlled to 10 to 300 $\mu$m, more preferably 10 to 150 $\mu$m. By carrying out the powder fuel ejection, the primary air ejection and the liquid fuel spray in the above-mentioned manner, the primary air ratio which refers to a ratio of the total amount of the primary air ejected through the annular powder fuel-ejection opening and the outer and inner primary air-ejection openings to the theoretical combustion air amount can be reduced from the conventional value of 20 to 25% to 8 to 15%, preferably 8 to 12%, and the reduction in the primary air amount is compensated by an increase in the high temperature secondary air amount, and thus the burning can be effected to an extent such that the combustion velocity increases, the combustion flame is formed in the narrow angle short flame form, and the fire point temperature can be satisfactorily increased, while no damage is given to the furnace wall. Namely, in the burning method using the mix-burning apparatus of the present invention, the ejection stream momentum can be increased by 25 to 35% based on that in the conventional method, while the secondary air-accompanying momentum and the accompanying time are held in the similar levels to those in the conventional method.

In the present invention, the adjustment of the droplet size of the sprayed liquid fuel to 10 to 300 $\mu$m can be effected by appropriately controlling the spraying pressure applied to the liquid fuel, and the form and dimensions of the spraying openings in response to the type and viscosity of the liquid fuel, the spraying rate and the spraying temperature. The droplet size of the sprayed liquid fuel can be calculated in accordance with the equation shown below.

$$\bar{d} = 47\left(\frac{D}{V_e}\right)\left(\frac{g\cdot\sigma_e}{\delta_g}\right)^{0.25}\left[1+3.31\frac{\mu_e}{(\sigma_e\cdot\delta_e\cdot D)^{0.5}}\right]$$

$$dmax=(2-2.5)\bar{d}$$

d: Average droplet size [m]

$V_e$: Fuel-spraying velocity [m/s]

$\delta_g$: Ambient gas density [kg/m$^3$]

$\delta_e$: Fuel density [kg/m$^3$]

$\sigma_e$: Surface tension of fuel [N/m]

D: Diameter of spraying opening [m]

dmax: Largest droplet size [m]

$\mu_e$: Viscosity of fuel [Pa·S]

The ejection stream momentum and the accompanying momentum of the secondary air can be calculated in accordance with the afore-mentioned equations (1) and (2).

In the mix-burning method of the present invention, the ejection velocity ($U_o$) of the primary air is increased from the conventional value of about 100 m/sec to a level of 200 to 300 m/sec, to increase the ejection stream momentum ($G_o$), the accompanying momentum ($G_e$) of the secondary air increases in proportion to the ejection stream momentum ($G_o$). However, when the accompanying momentum ($G_e$) and the accompanying time of the secondary air are held at the similar levels to those in the conventional method, the mixing of the flame ejection stream with air and the combustion in an initial stage are effected in the similar conditions to those in the conventional method, and therefore, the amount of the primary air can be reduced. In this case, the reduction in the primary air amount is compensated by the high temperature secondary air, and thus the combustion velocity is enhanced and the combustion efficiency is improved.

By utilizing the mix-burning apparatus and method of the present invention, the narrow angle short flame type combustion flame can be generated, and thus the swirl number (which is a non-dimensional amount representing a turning intensity defined by the afore-mentioned equation (3)) can be made zero and the flame stream can be formed into a natural ejection stream.

EXAMPLES

Example 1 and Comparative Example 1

In Example 1, a powder fuel-burning apparatus of the present invention as shown in FIGS. 2, 3(A) and 3(B) is used for a cement-calcining rotary kiln, and a cement was produced by the rotary kiln under the conditions shown in Table 1. The results are shown in Table 1.

In Comparative Example 1, a cement was produced by using a conventional coal powder-burning apparatus under the conditions shown in Table 1. The results are shown in Table 1.

TABLE 1

| | Example 1 | Comparative Example 1 |
|---|---|---|
| Production conditions | | |
| Calorific value of coal (kcal/kg) | 6800 | 6800 |
| Fineness of fine coal powder (Residue % on 90 $\mu$m mesh) | 10 to 20 | 10 to 20 |
| Outer primary air straight stream velocity (m/sec) | 250 to 300 | 100 to 120 |
| Inner primary air straight stream velocity (m/sec) | 250 to 300 | 80 to 0 |
| Coal powder stream velocity (m/sec) | 30 to 50 | 30 to 50 |
| Inner primary air turning stream velocity (m/sec) | None | 0 to 80 |
| Primary air ratio | 11 | 20 |
| Results | | |
| Ejection stream momentum ratio(*)1 | 125 to 135 | 100 |
| Secondary air-accompanying momentum ratio(*)1 | 100 to 110 | 100 |
| Secondary air-accompanying time ratio(*)1 | 90 to 100 | 100 |
| Swirl number (SW) | 0 | 0.03 to 0.10 |
| Production rate (T/day) | 2800 | 2795 |
| Combustion ratio (kcal/kg) | 719 | 744 |
| Furnace end temperature (° C.) | 1040 | 1090 |
| CO amount at furnace end (%) | Undetected | 1 to 2 |

[Note for Table 1]
(*)1Each value of Example 1 is a relative value to the value 100 of Comparative Example 1

As Table 1 clearly shows, in Example 1, even when the secondary air-accompanying momentum and accompanying time were held in the similar levels to those of Comparative Example 1, the ejection stream momentum could be increased at 25 to 35%, the swirl number could be decreased, the production rate could be increased, the combustion ratio could be reduced and the furnace end temperature could be decreased.

Example 2 and Comparative Example 2

In Example 2, a liquid fuel-burning apparatus of the resent invention as shown in FIGS. 4, 5(A) and 5(B) is used for a cement-calcining rotary kiln, and a cement was produced by the rotary kiln under the conditions shown in Table 2. The results are shown in Table 2.

In Comparative Example 2, a cement was produced by using a conventional heavy oil-burning apparatus under the conditions shown in Table 2. The results are shown in Table 2.

TABLE 2

| | Example 1 | Comparative Example 1 |
|---|---|---|
| Production conditions | | |
| Calorific value of liquid fuel (C heavy oil) (kcal/kg) | 10,200 | 10,200 |
| Outer primary air straight stream velocity (m/sec) | 250 to 300 | 100 to 120 |
| Inner primary air straight stream velocity (m/sec) | 250 to 300 | 80 to 0 |
| Droplet size of liquid fuel (μm) | 150 | 150 |
| Inner primary air turning stream velocity (m/sec) | None | 0 to 80 |
| Primary air ratio | 7 | 15 |
| Results | | |
| Ejection stream momentum ratio(*)1 | 125 to 135 | 100 |
| Secondary air-accompanying momentum ratio(*)1 | 100 to 110 | 100 |
| Secondary air-accompanying time ratio(*)1 | 90 to 100 | 100 |
| Swirl number (SW) | 0 | 0.03 to 0.10 |
| Production rate (T/day) | 2800 | 2795 |
| Generated calory (kcal/kg) | 719 | 744 |
| CO amount at furnace end (%) | Undetected | 1 to 2 |

(*)1Based on the value 100 in Comparative Example 2

As Table 2 clearly shows, in Example 2, even when the secondary air-accompanying momentum and accompanying time were held in the similar levels to those of Comparative Example 2, the ejection stream momentum could be increased at 25 to 35%, the swirl number could be decreased, the production rate could be increased, the combustion ratio could be reduced and the furnace end temperature could be decreased.

Example 3 and Comparative Example 3

In Example 3, a mix-burning apparatus of the present invention as shown in FIGS. 6, 7(A) and 7(B) is used for a cement-calcining rotary kiln, and a cement was produced by the rotary kiln under the conditions shown in Table 3. The results are shown in Table 3.

In Comparative Example 3, a cement was produced by using a conventional coal powder and liquid fuel-mix-burning apparatus under the conditions shown in Table 3. The results are shown in Table 3.

TABLE 3

| | Example 1 | Comparative Example 1 |
|---|---|---|
| Production conditions | | |
| Calorific value of coal (kcal/kg) | 6800 | 6800 |
| Fineness of fine coal powder (Residue % on 90 μm mesh) | 10 to 20 | 10 to 20 |
| Outer primary air straight stream velocity (m/sec) | 250 to 300 | 100 to 120 |
| Inner primary air straight stream velocity (m/sec) | 250 to 300 | 80 to 0 |
| Coal powder stream velocity (m/sec) | 30 to 50 | 30 to 50 |
| Inner primary air turning stream velocity (m/sec) | None | 0 to 80 |
| Liquid fuel | C-heavy oil | C-heavy oil |
| Calorific value (kcal/kg) | 10,200 | 10,200 |
| Droplet size (μm) | 150 | 150 |
| Primary air ratio | 11 | 20 |
| Results | | |
| Ejection stream momentum ratio(*)1 | 125 to 135 | 100 |
| Secondary air-accompanying momentum ratio(*)1 | 100 to 110 | 100 |
| Secondary air-accompanying time ratio(*)1 | 90 to 100 | 100 |
| Swirl number (SW) | 0 | 0.03 to 0.10 |
| Production rate (T/day) | 2800 | 2795 |
| Generated calory (kcal/kg) | 719 | 744 |
| Furnace end temperature (° C.) | 1040 | 1090 |
| CO amount at furnace end (%) | Undetected | 1 to 2 |

As Table 3 clearly shows, in Example 3, even when the secondary air-accompanying momentum and accompanying time were held in the similar levels to those of Comparative Example 3, the ejection stream momentum could be increased by 25 to 35%, the swirl number could be decreased, the production rate could be increased, the combustion ratio could be reduced and the furnace end temperature could be decreased.

INDUSTRIAL APPLICABILITY

By using the burning apparatus and method of the present invention, a powder fuel or a liquid fuel or a powder fuel and a liquid fuel can be burnt to form a narrow angle short flame-type flame and the fire point temperature can be sufficiently increased, without damaging the furnace wall. Therefore, the practical effect of the apparatus and method of the present invention is very good.

What is claimed is:

1. An apparatus for burning a fuel comprising a means for ejecting at least one fuel selected from powder fuels and liquid fuels; an outer primary air ejection pipe (23) arranged on the outer side of the fuel-ejection means and having a plurality of outer primary air-ejection openings (24) through which primary air is ejected in parallel to the fuel-ejection direction of the fuel-ejection means; and an inner primary air-ejection pipe (27) arranged on the inner side of the fuel-ejection means and having a plurality of inner primary air-ejection openings (28) through which primary air is ejected in parallel to the fuel-ejection direction of the fuel-ejection means, wherein, the fuel-ejection means comprises a powder fuel-ejection pipe (25) having an annular ejection opening (26) through which a powder fuel is ejected together with air for conveying the powder fuel, and the plurality of air-ejection openings (24) of the outer primary air-ejection pipe (23) and the plurality of ejection openings (28) of the inner primary air-ejection pipe (27) are arranged on concentric circumferences in such a manner that the annular ejection opening of the powder fuel-ejection pipe is located between the outer air-ejection openings and the inner air-ejection openings, and the inner primary air-ejection openings are located apart from any straight lines extending through both the center points of the outer primary air-ejection openings and the center point of the concentric circumferences.

2. A method of burning a powder fuel in a fuel burning apparatus comprising a means for ejecting a powder fuel, an outer primary air-ejection pipe (23) arranged on the outer side of the fuel-ejection means and having a plurality of outer primary air-ejection openings (24) and an inner primary air-ejection pipe (27) arranged on the inner side of the fuel-ejection means and having plurality of inner primary air-ejection openings (28), the fuel-ejection means comprising a powder fuel-ejection pipe (25) having an annular ejection opening (26), the plurality of air-ejection openings (24) of the outer primary air-ejection pipe (23) and the plurality of ejection openings (28) of the inner primary air-ejection pipe (27) being arranged on concentric circumferences in such a manner that the annular ejection opening of the powder fuel-ejection pipe is located between the outer air-ejection openings and the inner air-ejection openings, and the inner primary air-ejection openings being located apart from any straight lines extending through both the center points of the outer primary air-ejection openings and the center point of the concentric circumferences, which method comprises:

ejecting a powder fuel together with the powder fuel-conveying air through the annular fuel ejection opening; and ejecting primary air through the outer and inner primary air-ejection openings in the same direction as that of the powder fuel-ejection stream, to form outer and inner primary air-ejection straight streams between which the powder fuel-ejection stream is interposed.

3. The fuel-burning method as claimed in claim 2, wherein when the powder fuel is burnt in a rotary kiln, high temperature secondary air streams are introduced from a product-cooling system arranged upstream from the rotary kiln into the rotary kiln; and the introduced high temperature secondary air streams are mixed into the combustion flame of the powder fuel.

4. The fuel-burning method as claimed in claim 2, wherein the powder fuel is ejected at an ejection velocity of 30 to 50 m/sec through the annular fuel-ejection opening, and the outer and inner primary air-ejection straight streams are ejected at an ejection velocity of 200 to 300 m/sec through the air-ejection openings.

5. The fuel-burning method as claimed in claim 2, wherein the total amount of the air ejected through the powder fuel-ejection annular opening and the outer and inner primary air-ejection openings is controlled to within 8 to 15% of the theoretical combustion air amount.

* * * * *